US005944203A

United States Patent [19]

Vlah et al.

[11] Patent Number: 5,944,203

[45] Date of Patent: Aug. 31, 1999

[54] SLATWALL MERCHANDISE DISPLAY SYSTEM WITH DUAL THROUGH P-SHAPED CHANNELS

[75] Inventors: John A. Vlah, Chagrin Falls; John I. Kuzma, Cleveland; Anthony J. Santarelli, N. Olmsted; Michael E. Schindley, Parma, all of Ohio

[73] Assignee: American Greetings Corporation, Cleveland, Ohio

[21] Appl. No.: 09/071,926

[22] Filed: May 1, 1998

[51] Int. Cl.[6] ..... A47B 43/00

[52] U.S. Cl. ..... 211/189; 211/87.01; 211/94.01

[58] Field of Search ..... 211/189, 57.1, 211/59.1, 193, 187, 126.1, 126.5, 88.01, 87.01, 94.01

[56] References Cited

U.S. PATENT DOCUMENTS

| | | | |
|---|---|---|---|
| 2,754,974 | 7/1956 | Larson | 211/87 |
| 3,698,565 | 10/1972 | Weber | 211/87 |
| 4,008,872 | 2/1977 | Thompson | 211/88.01 X |
| 4,083,456 | 4/1978 | Genn et al. | 211/55 |
| 4,189,123 | 2/1980 | Johnson | 211/187 X |
| 4,405,052 | 9/1983 | Spiros | 211/187 X |
| 4,429,850 | 2/1984 | Weber et al. | 211/193 |
| 4,450,970 | 5/1984 | Shepherd | 211/189 |
| 4,508,231 | 4/1985 | Honickman | 211/189 X |
| 4,531,331 | 7/1985 | Itagaki | 211/189 X |
| 4,607,753 | 8/1986 | Radek | 211/87 |
| 4,629,076 | 12/1986 | Amstutz et al. | 211/87 X |
| 4,678,151 | 7/1987 | Radek | 211/94 X |
| 4,809,479 | 3/1989 | Tierno et al. | 211/189 X |
| 5,018,323 | 5/1991 | Clausen | 211/87 X |
| 5,109,993 | 5/1992 | Hutchison | 211/59.1 X |
| 5,148,925 | 9/1992 | Althoff et al. | 211/94 X |
| 5,228,579 | 7/1993 | Kaufman | 211/87 |
| 5,328,037 | 7/1994 | Fujii | 211/88 X |
| 5,360,121 | 11/1994 | Sothman | 211/87 |
| 5,412,912 | 5/1995 | Alves | 211/94 |
| 5,484,067 | 1/1996 | Sothman | 211/87 |
| 5,622,010 | 4/1997 | Weber | 211/88.01 X |
| 5,655,674 | 8/1997 | Holztrager | 211/87.01 X |

*Primary Examiner*—Daniel P. Stodola
*Assistant Examiner*—Erica B. Harris
*Attorney, Agent, or Firm*—Calfee, Halter & Griswold LLP

[57] ABSTRACT

A merchandise display system for supporting products in a retail environment in a vertical array, the system having channeled slatwall with a plurality of horizontal, vertically adjacent generally P-shaped channels upon which different types of hardware and bracketry can be engaged. The P-shaped channels have upper and lower troughs in which different types of hooks and brackets are insertable, with the sections of the channels as load bearing surfaces. The slatwall can be formed with at least two channels extending from a single contiguous rear wall. The rear wall of the slatwall is securable to a backer panel with corrugations which are orthogonal to the channels. The slatwall is fastened to one or more backer panels by lances which protrude from the backer panel, and/or by securement fasteners between the channels of the slatwall.

22 Claims, 6 Drawing Sheets

SLATWALL MERCHANDISE DISPLAY SYSTEM WITH DUAL THROUGH P-SHAPED CHANNELS

FIELD OF THE INVENTION

The present invention pertains generally to merchandise displays and related hardware for displaying products in a retail environment and, more particularly, to retail merchandise product display systems which are selectively configurable to display different types of products in different arrangements, and which are capable of supporting different types of brackets and hooks.

BACKGROUND OF THE INVENTION

Many different types of retail display systems have been devised to display relatively small consumer items on a vertical wall support. For example, U.S. Pat. No. 3,698,565 discloses a system with double-walled L-shaped channel-like elements which protrude from a vertical wall. The channels have grooves which are open along the top side, by which hooks are engaged with the channel. U.S. Pat. No. 4,450,970 describes a sheet metal slatwall with downwardly opening channels secured together in a vertically superimposed arrangement. Display hardware is inserted in the channels to hold merchandise on supports cantilevered from a back support wall.

U.S. Pat. Nos. 4,531,331; 4,809,479 and 5,228,579 describe examples of display systems which employ extruded slatwalls which are generally T-shaped. The channel extrusions of the latter two patents have interlocks for positioning and securing vertically adjacent slatwall panels to form a continuous display. Some such channels may also be fabricated by roll forming sheet steel. Although each of these systems provide multiple channels for selective arrangement of hooks and product support brackets, they are generally expensive to manufacture, and difficult to assemble and disassemble. Most of the channels of the prior art which make up a slatwall are individually manufactured and then assembled in the horizontal parallel arrangement upon a vertical back wall. Individual channel manufacture and assembly is expensive and tedious. With individual channels which interlock, the slightest misalignment of even a single channel will skew an entire display. Also, some form of a vertical interconnection is typically placed across the front of the channels to interconnect them. This detracts from the appearance of the display and reduces the available space for bracketry.

Some of the more complex channel cross-sectional shapes are designed to accept only a particular type of hook or bracket. This limits the adaptability of the display and the different types of products which may be supported. Another deficiency of the prior art is in the area of overall strength or weight bearing limits of the system. Channels made from extruded aluminum or molded plastic are especially susceptible to failure under the moment loading of long hooks attached to a bracket engaged with the channel.

SUMMARY OF THE INVENTION

The present invention overcomes these and other disadvantages of the prior art, while providing a novel slatwall merchandise display system which accepts a wide variety of hooks and brackets, has greater strength, is self-aligning and economically manufactured. As used herein with reference to the subject invention, the term "slatwall" refers to a plurality of generally horizontally arranged channels or "slats" into which brackets or hooks are engaged.

In accordance with one aspect of the invention, there is provided a slatwall merchandise display system which utilizes a novel channel having generally P-shaped cross-sectional configuration with upward opening trough, and downward opening trough, and configured to accept product support hooks or brackets. The novel P-shaped channel is inherently rigid, aesthetically pleasing, and readily manufacturable. The channel includes a rear wall portion, and a channel which extends from the rear wall, the channel formed by an upper flange extending generally orthogonally from the rear wall and connected at a point spaced from the rear wall to an inner wall which is generally parallel to the rear wall, the inner wall connected through a radiused bend to an outer wall which is also generally parallel to the rear wall and to the inner wall, the outer wall extending from one side of the upper flange to an opposite side of the upper flange, the outer wall connected through at least one radiused bend to a stiffening web located between the outer wall and the rear wall, and spaced from the outer wall whereby a gap is created between the outer wall and the stiffening web, the stiffening web connected to a lower flange which extends back to the rear wall, the lower flange being generally parallel and adjacent to the upper flange, and a portion of the rear wall extending from the lower flange away from the upper flange.

In accordance with another aspect of the invention, there is provided a merchandise display system for supporting a plurality of merchandise support structures and merchandise in a generally vertically oriented array, the merchandise display system having at least one backer panel adapted to be supported in a generally vertical orientation, and to be substantially flush against a channeled slatwall, the backer panel having one or mode vertically oriented corrugations defined by first and second walls which are interconnected, wherein the first and second walls of the backer panel are in parallel planes, and one of the walls of the backer panel is placed substantially flush against a channeled slatwall, at least one channeled slatwall having a rear wall which is secured substantially flush against a wall of the backer panel, the channeled slatwall further having a generally P-shaped channel which extends from the rear wall and is formed by an upper flange which extends from the rear wall, the upper flange connected to a generally perpendicular slatwall inner wall, the slatwall inner wall connected through a radiused bend to an outer wall which is parallel and closely adjacent to the inner wall, the outer wall connected through a bend to a stiffening web parallel to the outer wall and positioned between the outer wall and the rear wall and spaced from the outer wall, and a lower flange which extends from the stiffening web to the rear wall, the rear wall of the channeled slatwall secured to a wall of the backer panel by attachment means at a point on the rear wall which is overlapped by the outer wall and stiffening web.

These and other aspects of the invention are herein described in particularized detail with reference to the accompanying Figures.

DETAILED DESCRIPTION OF PREFERRED AND ALTERNATE EMBODIMENTS

Figure 1:
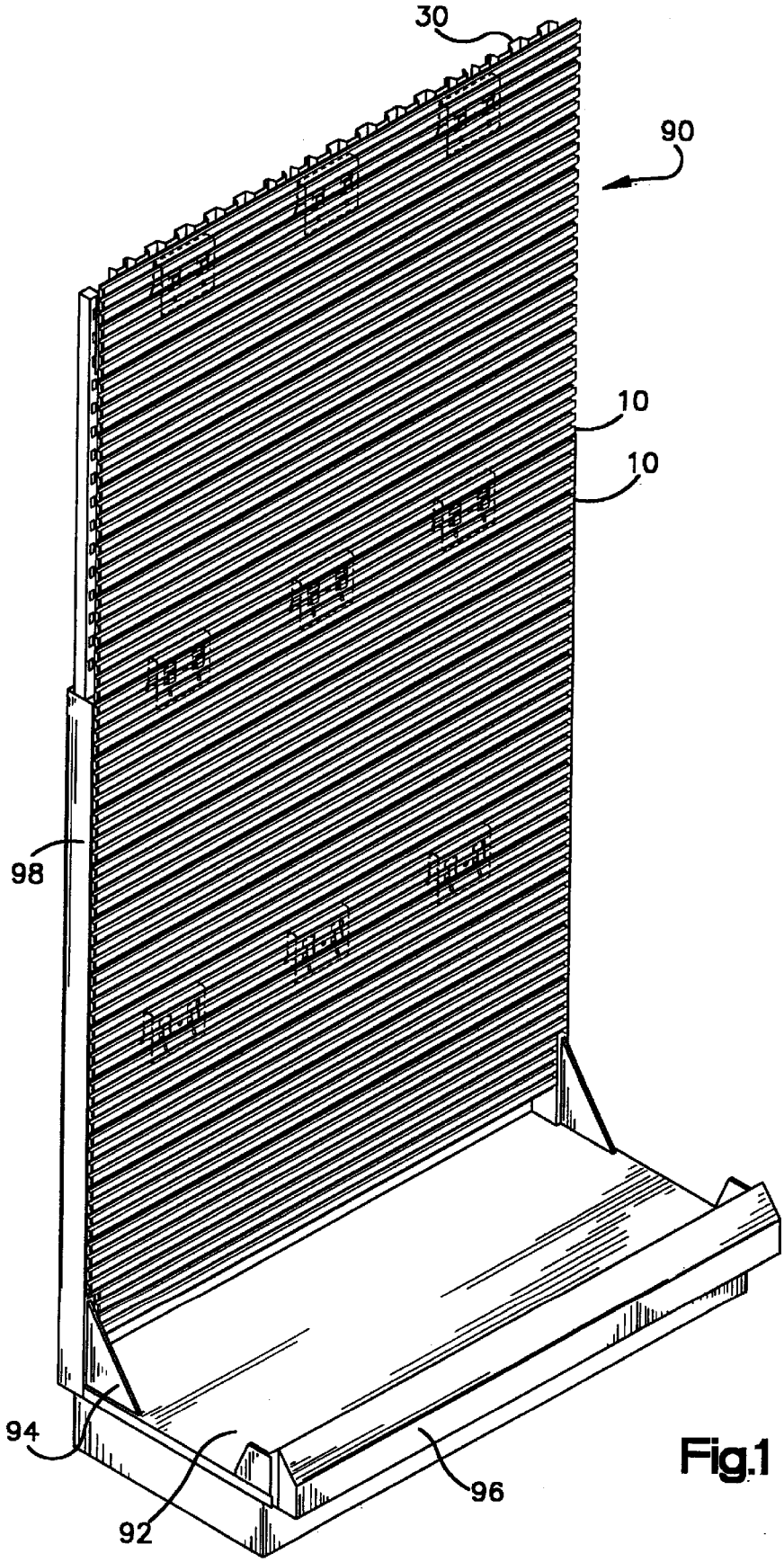
FIG. 1 is a perspective view of a slatwall merchandise display system constructed in accordance with the present invention.

Referring now to the drawings and in particular to FIG. 1, a merchandise display wall or system, indicated generally at 90, is made up of a plurality of horizontally arranged channeled slatwalls secured in a vertically adjacent arrangement to one or more corrugated backer panels 30, a base 92, gusset sections 94, a front base cap 96, and vertical wall supports 98. The corrugations of the backer panels 30 may be vertically oriented to provide a structural matrix or grid relative to the horizontally disposed channels of the slatwall 10, as further described herein.

The merchandise display walls 90 may be dimensioned at any desired width and vertical extent in order to fit within and optimize a product display area in a store. FIG. 1 represents only one possible combination of a base, base cap and vertical wall supports. Other similar hardware can be used to form a merchandise display wall in accordance with the invention. As further described herein, the channels of the slatwall 10 supported by the merchandise display wall 90 provide a plurality of closely spaced horizontal frontal openings 100 (see FIGS. 6 and 7) which lead to upper and lower troughs formed by the channels. Because each of the channels of the slatwall are continuous across the entire horizontal extent of the display, hooks or brackets can be positioned upon any channel at any location of the display wall 90.

Figure 2:
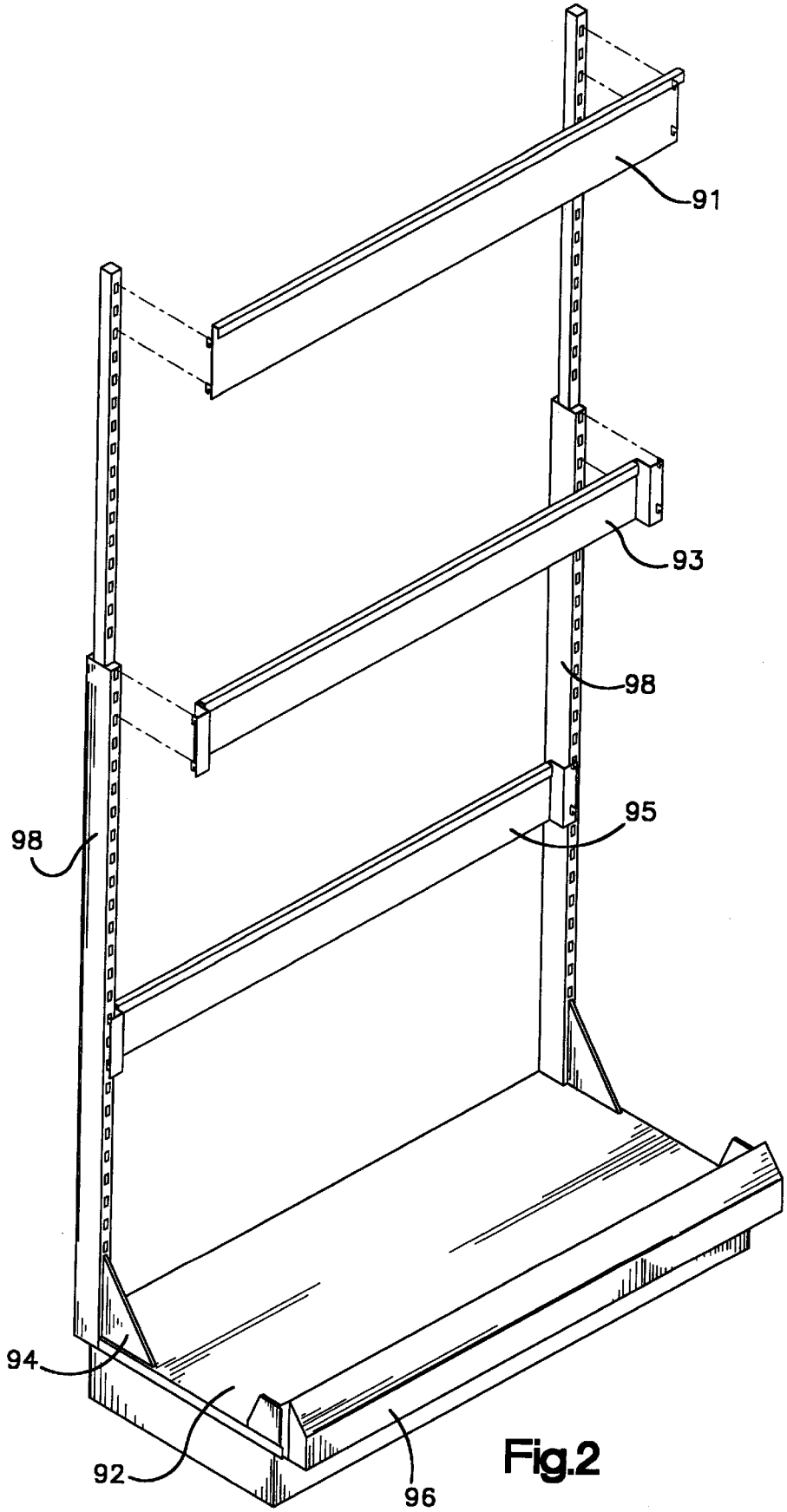
FIG. 2 is an exploded perspective view of the wall portion of the merchandise display system of FIG. 1, with the slatwall display panels and mounting brackets removed.
Figure 3:
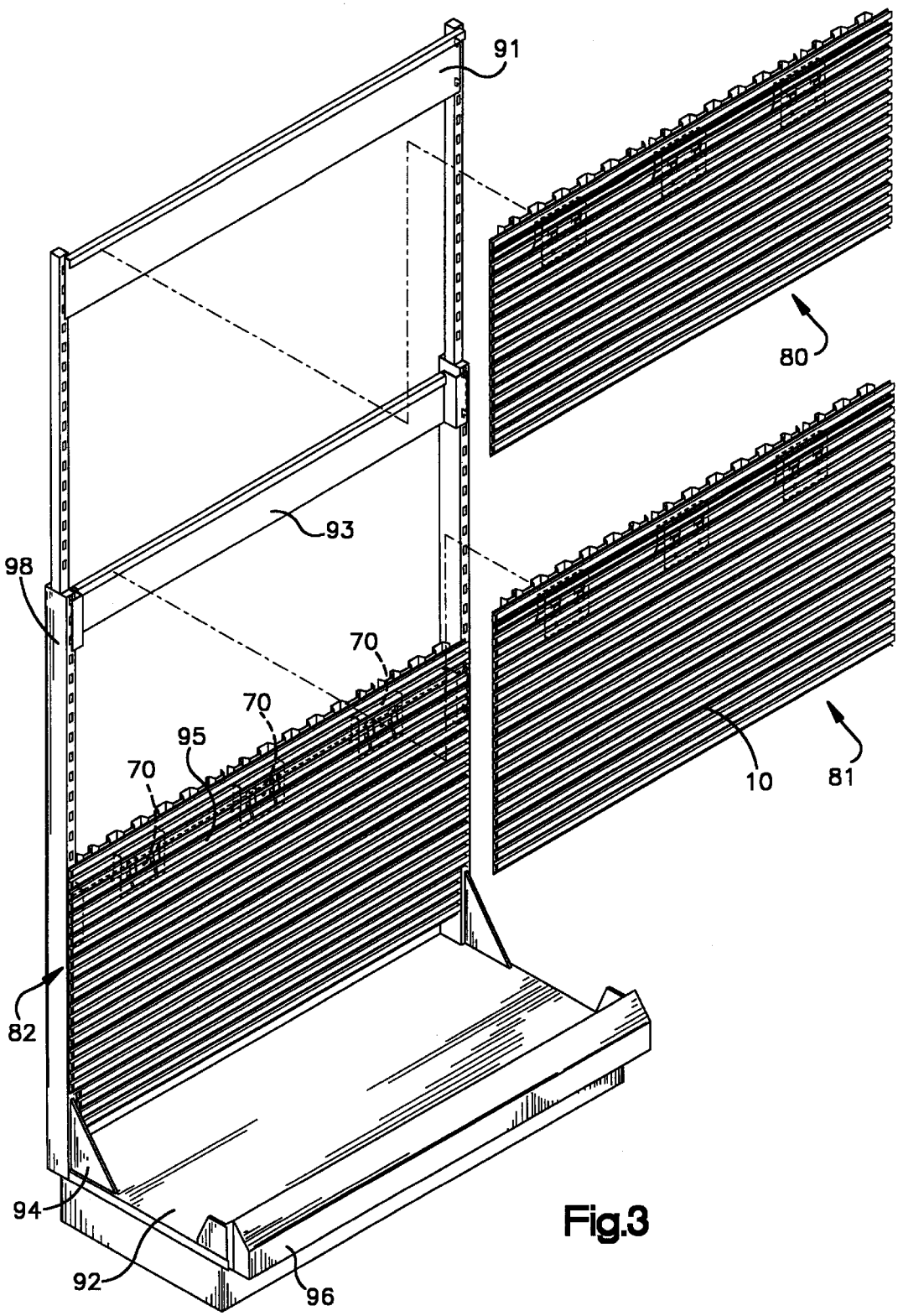
FIG. 3 is an exploded perspective view of the merchandise display system of FIG. 1.
Figure 4:
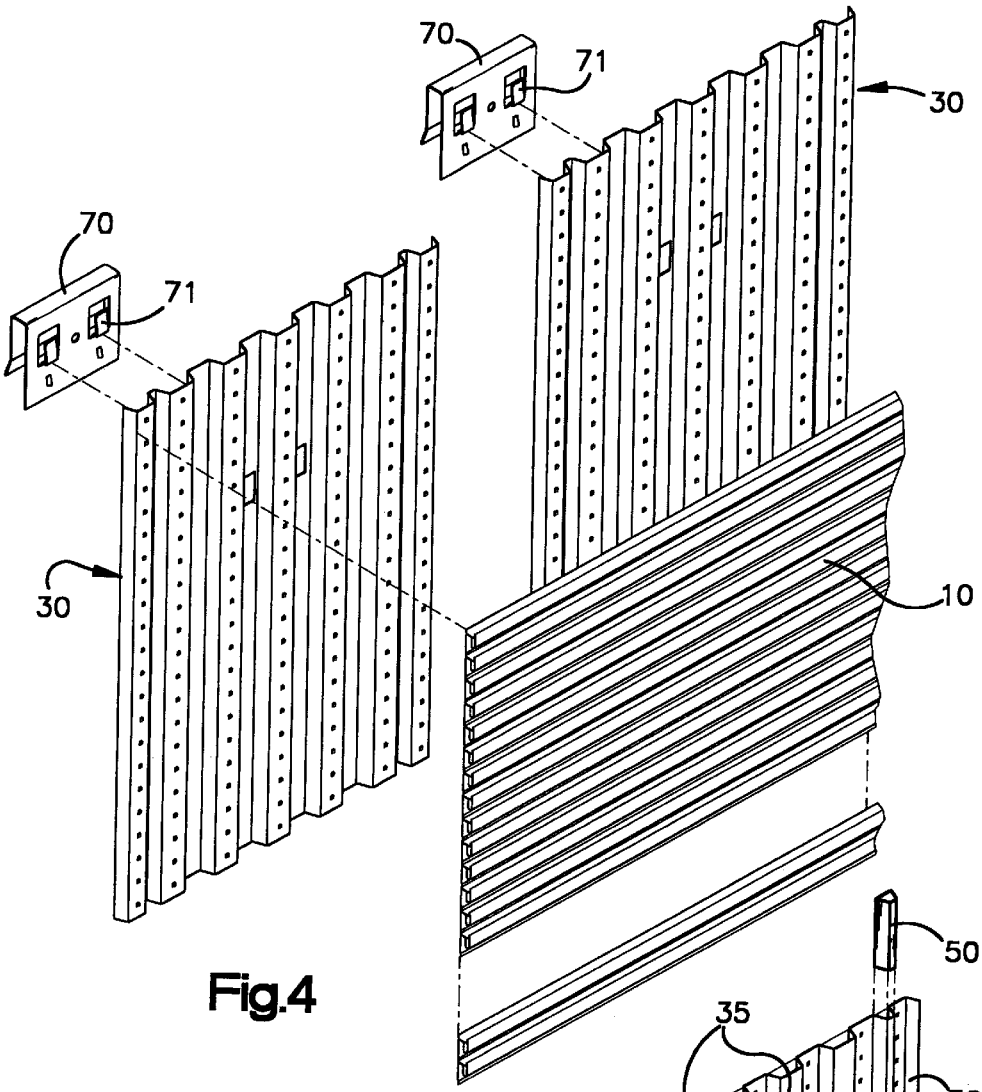
FIG. 4 is an exploded perspective view of a slatwall merchandise display system of the present invention.

FIG. 2 is an assembly view of typical framing elements of the display wall or system 90. Horizontal panel stringers 91, 93 and 95 are secured to vertical supports 98 to form a frame which supports the channeled slatwall 10. As shown in FIG. 3, panel stringers 91, 93 and 95 provide hanging points for separate slatwall panel sections 80, 81 and 82. As shown in FIG. 4, each separate slatwall panel section includes a plurality of vertically adjacent channeled slatwalls 10 connected to one or more backer panels 30. The channeled slatwall preferably extends the entire width of the display. The backer panels 30 are preferably corrugated, with the corrugation ribs oriented generally perpendicular to the channels of the slatwall 10, and preferably extend the entire height of the panel sections. By fixedly securing the channeled slatwall 10 to the backer panel or panels 30, a reinforced grid or matrix structure is created with excellent torsional stiffness and overall strength.

Also shown in FIG. 4 are panel hanging clips 70 by which the backer panels are hung from stringers 91, 93 and 95, shown in FIG. 2. The hanging brackets 70 can be secured to the panel section 80 by integral outwardly and upwardly opening clips 71 which extend through rectangular holes 34 in the inner corrugated backer panel walls 35 of backer panel 30. Different embodiments with different numbers of clips 71 to connect different configurations of backer panels are also envisioned in lieu of, or in combination with the hanging bracket and corrugated backer panels of FIGS. 4 and 5.

Figure 5:
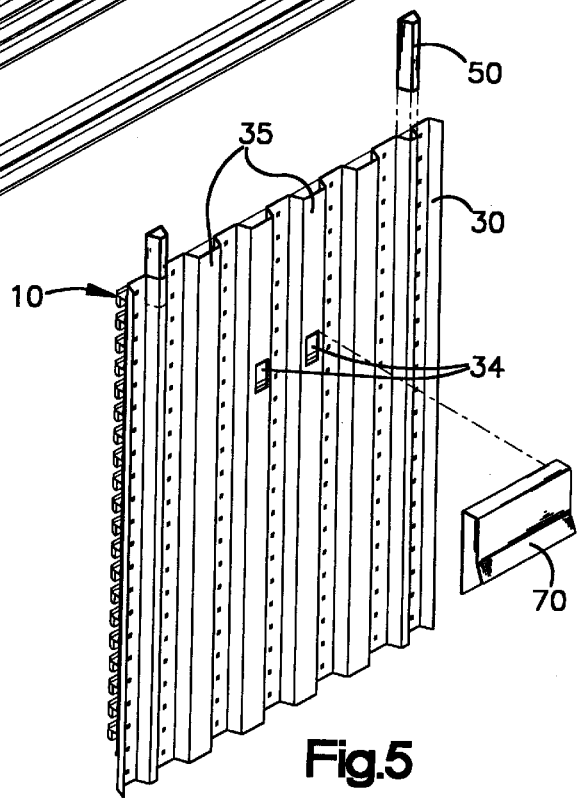
FIG. 5 is a perspective view of the back side of a display panel subassembly.
Figures 6, 7:
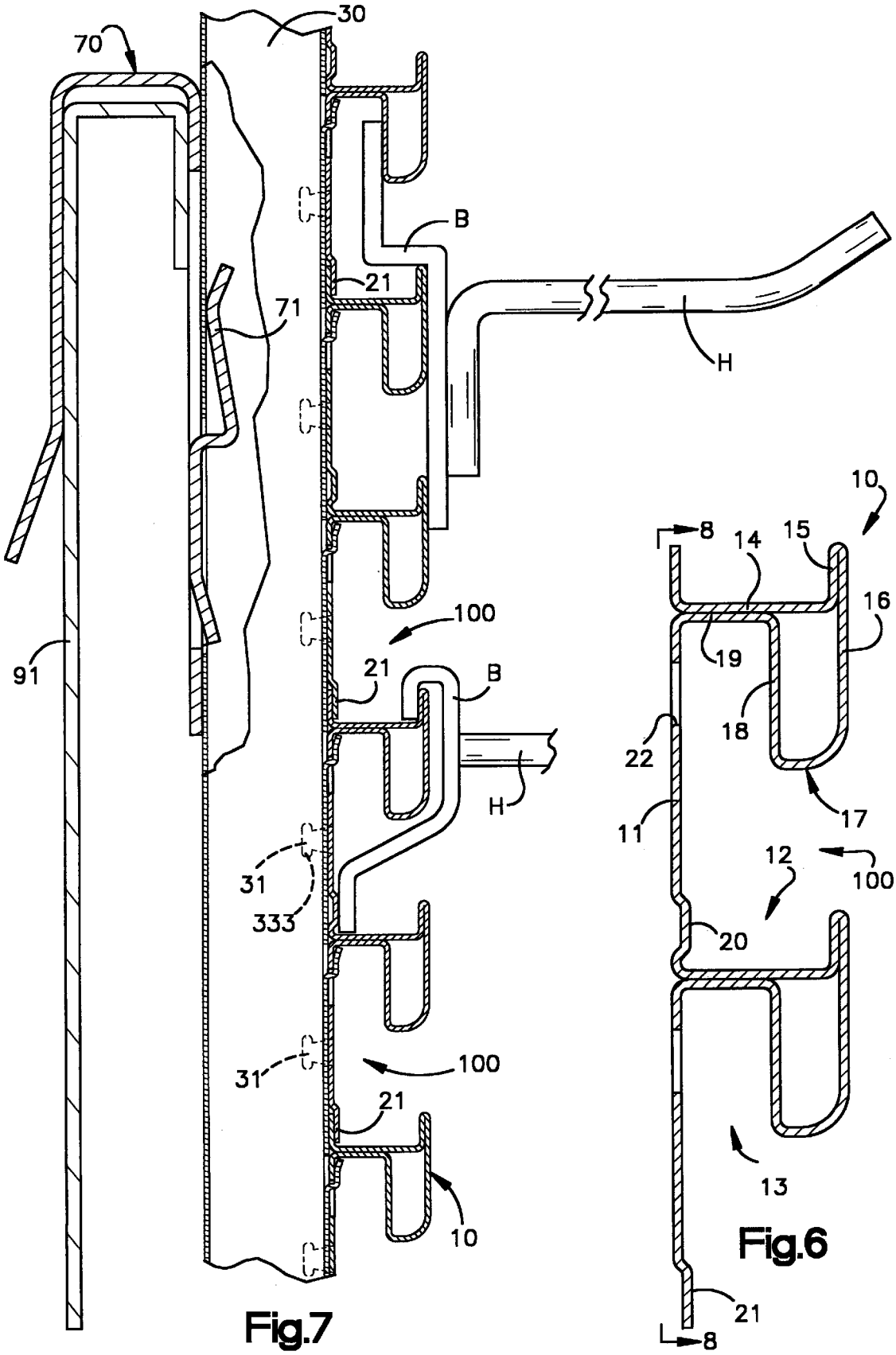
FIG. 6 is an enlarged cross-sectional view of a single one-piece slatwall panel section configured in accordance with the present invention.
FIG. 7 is a partial cross-sectional view of the display panel sub-assembly of the invention.

FIGS. 4 and 5 further illustrate a representative panel section such as 80, including a plurality of horizontally disposed channeled slatwalls 10 connected to one or more corrugated backer panels 30. The channeled slatwall 10 is secured to the outer wall 33 of the corrugations of the backer panels at, for example, points 31 by fasteners, welds or other suitable attachment means. Preferably, the channeled slatwall 10 is secured to the backer panels 30 by clinch-joining means, wherein a punch tool displaces material through a cross-section of the slatwall and the outer wall 33 of the backer panel, forming a head 333 on the opposite side of wall 33, as shown in FIG. 7. A preferred form or method of clinch joining is known as Tog-L-Locs®. Spot or pressure welds could also be used. Preferably, the connection points 31 are positioned in an area of the rear wall 11 which is overlapped by the outer wall 14 and stiffening web 15 of the channel so that the connection are not visible from the front of the display.

Figure 4A:
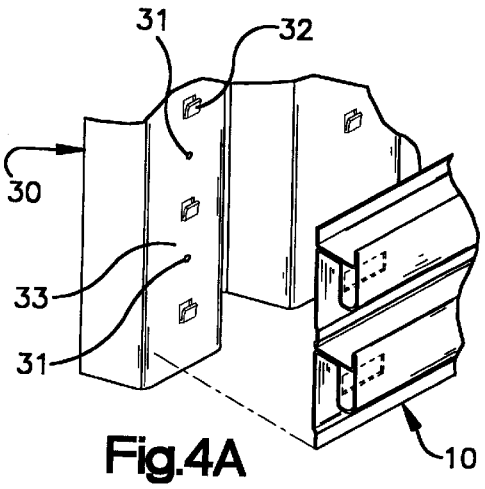
FIG. 4A is an enlarged view of the lower left corner of the corrugated backer board of the merchandise display system of FIG. 1; 4.
Figure 8:
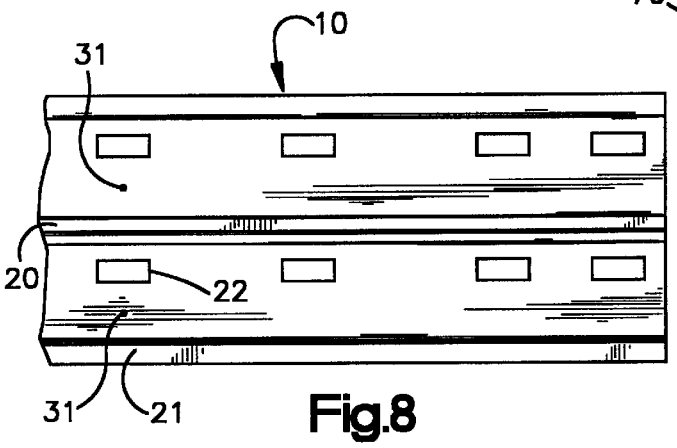
FIG. 8 is a rear view of the slatwall panel section of FIG. 6.

FIG. 4A shows lances 32 formed or punched to extend from the outer walls 33 of the backer panel 30 to face the back side of the channeled slatwall 10. The lances engage in holes 22 in a rear wall of the channeled slatwall 10 (shown in FIG. 8), to insure true orthogonal arrangement of the slatwall upon the backer panel which is further strengthened by attachment points 31, located intermediate of the lances and lance engagement holes.

FIG. 6 illustrates a cross section of a preferred embodiment of the channeled slatwall 10, formed in a single piece, cold-rolled sheet metal, double channel configuration. The slatwall 10 has a generally planar rear wall 11 from which extend P-shaped channels. The P-shape of the channel is oriented generally orthogonal to the rear wall 11. Each P-shaped channel is formed by an upper flange 14, which extends orthogonally from the rear wall, and a connecting inner wall 15, which is orthogonal to flange 14 and extends upward relative to wall 11. The inner wall 15 is connected to an outer or front wall 16 through an approximately 180 degree bend. The front wall 16 extends downwardly, closely adjacent and generally parallel to inner wall 15 and rear wall 11. The outer wall 16 has a lower edge positioned below the upper flange 14. The lower edge of the front wall 16 is connected through at least one radiused arc 17 which forms a 180 degree bend to an upwardly extending stiffening web 18. The stiffening web 18 extends from radiused arc 17, spaced from and generally parallel to outer wall 16 and rear wall 11, to a lower flange 19. Lower flange 19 extends orthogonally from the stiffening web 18 closely adjacent and parallel to upper flange 14, and is contiguous to the rear wall 11 which continues downward toward the adjacent channel.

By this construction the generally P-shaped channel forms an upper trough 12 and a lower trough 13 in which various bracketry and hooks are engageable, with the various flanges and walls of the channel serving as load bearing contact surfaces. As shown in FIG. 7, merchandise support hardware, such as brackets B and hooks H are engaged in the channels with the upper and/or lower channels. As shown, the display hardware may engage one or more adjacent channels. Heavier duty hardware may contact several or more channels or span several channels to increase load capacity.

Also shown in FIG. 6, integral to and coincident with the rear wall 11 of the channel, is a connecting lip 21 which is generally parallel to and offset from the rear wall by a distance approximately equal to the thickness of the material of the channeled slatwall 10. The uppermost edge of the rear wall 11 of the slatwall 10 does not have such an offset so that it fits under the offset connecting lip 21 of the slatwall immediately above, as shown in FIG. 7. The overlapping arrangement of the connecting lip 21 over the upper edge of the rear wall 11 of the adjacent slatwall further strengthens the display panel 80.

FIGS. 6 and 7 also illustrate a stiffening ridge 20 in the rear wall 11, located between the two P channels, and closely adjacent to the lower channel in the double channel slatwall embodiment. Other possible embodiments having two or more channels could have similar stiffening ridges located between the channels to provide increased torsional stiffness and strength.

Figure 9:
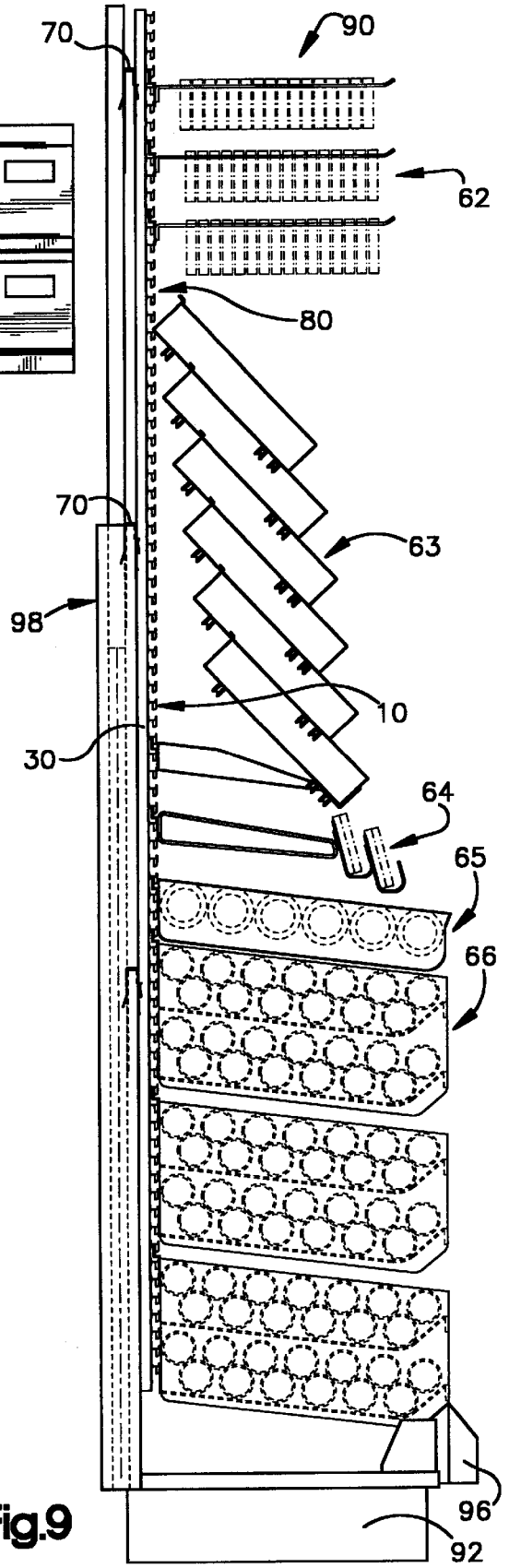
FIG. 9 is a cross-sectional view of the merchandise display system of the invention in combination with various types of support bracketry.

FIG. 9 illustrates a cross-section of a merchandise display wall 90 constructed in accordance with the invention, with merchandise display hardware indicated at 62, 63, 64, 65 and 66, upon display panel sections 80. As also shown in FIG. 5, backer panel alignment connectors 50 are inserted in the openings defined by the corrugations of the backer panels 30 against the planar rear wall 11 of the slatwall. The connectors 50 are, for example, in the form of double-ended plugs, with one half of the plug inserted in between the backer panel and slatwall of adjacent display panels 80, in order to align and connected the panels together.

The invention thus provides a universal merchandise display system which can be assembled in many different types of retail environments, and support a wide variety of hooks and bracketry. The preferred double P-shaped channeled slatwall is economical to manufacture, cutting manufacturing and assembly time in half relative to systems which use combined single channels.

Although described with reference to certain preferred and alternate embodiments, certain modifications and variations of the general principles of the invention which may be apparent to those of skill in the art are all within the scope of the invention as defined by the accompanying claims and equivalents thereto.

What is claimed is:

1. A channeled slatwall for it use as a generally vertically oriented support structure for a plurality of product support hardware configured to engage the channeled slatwall, the channeled slatwall comprising:

a single continuous piece of material having:

a substantially planar rear wall contiguous with a channel which extends from the rear wall, the channel formed by an upper flange extending generally orthogonally from the rear wall and connected at a point spaced from the rear wall to an inner wall which is generally parallel to the rear wall, the inner wall connected through a radiused bend to an outer wall which is also generally parallel to the rear wall and to the inner wall, the outer wall extending from one side of the upper flange to an opposite side of the upper flange, the outer wall connected through at least one radiused bend to a stiffening web located between the outer wall and the rear wall, the stiffening web being spaced from the outer wall whereby a gap is created between the outer wall and the stiffening web, the stiffening web connected to a lower flange which extends back to the rear wall, the lower flange being generally parallel to and closely abutting the upper flange, and a portion of the rear wall extending from the lower flange away from the upper flange.

2. The channeled slatwall of claim 1 comprising two channels, each channel having an upper flange, an inner wall, an outer wall, a stiffening web, and a lower flange, both channels extending from a single rear wall contiguous with the upper and lower flanges of the channels.

3. The channeled slatwall of claim 1 further comprising an offset ridge in the rear wall proximate to a flange of the channel which extends from the rear wall.

4. The channeled slatwall of claim 1 further comprising openings in the rear wall adapted to receive engagement or fastening means to support the slatwall on a support structure.

5. The channeled slatwall of claim 1 wherein the inner wall is connected to the outer wall through a 180 degree radiused bend.

6. The channeled slatwall of claim 1 wherein the outer wall is connected to the stiffening web through two radiused bends of approximately 90 degrees each, wherein a segment between the two 90 degree bends defines a spatial gap between the outer wall and the stiffening web.

7. The channeled slatwall of claim 1 in combination with a backer panel, the backer panel having a plurality of corrugations orientated generally orthogonal to the channels of the slatwall, and the rear wall of the channeled slatwall secured to the backer panel, and wherein the backer panel extends a substantial length of the channeled slatwall.

8. The channeled slatwall and backer panel combination of claim 7 wherein the rear wall of the slatwall is secured to the backer panel by attachment means located in a region where the rear wall is overlapped by the inner and outer walls of the channel.

9. The channeled slatwall and backer panel combination of claim 7 wherein the backer panel further comprises lances which engage with openings in the rear wall of the slatwall.

10. The channeled slatwall and backer panel combination of claim 7 in combination with a support structure which supports the slatwall and backer panel in a generally vertical orientation.

11. The channeled slatwall of claim 1 wherein the inner wall extends above the upper flange, and a portion of the outer wall is closely adjacent to the inner wall.

12. A merchandise display system for supporting a plurality of merchandise support structures and merchandise in a generally vertically oriented array, the merchandise display system comprising:

at least one backer panel adapted to be supported in a generally vertical orientation, and to be substantially flush against a channeled slatwall, the backer panel having a plurality of vertically oriented corrugations defined by first and second walls which are interconnected, wherein the first and second walls of the backer panel are in parallel planes, and one of the walls of the backer panel is placed substantially flush against a channeled slatwall, at least one channeled slatwall made of a single continuous piece of material having a rear wall which is secured substantially flush against a wall of the backer panel, the channeled slatwall having a generally P-shaped channel which extends from the rear wall and is formed by an upper flange which extends from the rear wall, the upper flange connected to a generally perpendicular slatwall inner wall, the slatwall inner wall connected through a radiused bend to an outer wall which is parallel and closely adjacent to the inner wall, the outer wall connected through a bend to a stiffening web parallel to the outer wall and positioned between the outer wall and the rear wall and spaced from the outer wall, and a lower flange which extends from the stiffening web to the rear wall, the rear wall of the channeled slatwall secured to a wall of the backer panel, wherein the backer panel extends a substantial length of the channeled slatwall.

13. The merchandise display system of claim 12 wherein one wall of the backer panel has lances which extend out of the plane of the wall to engage holes in the rear wall of the channeled slatwall.

14. The merchandise display system of claim 12 comprising at least two backer panels, wherein the backer panels are constructed by double ended plugs which are inserted between a wall of the backer panel and the rear wall of the channeled slatwall.

15. The merchandise display system of claim 12 wherein the combined backer panel and channeled slatwall are supported upon a frame structure by clips which engage openings in a wall of the backer panel and hang upon stringers of the frame structure.

16. The merchandise display system of claim 12 wherein the channeled slatwall is comprised of a plurality of P-shaped channels, and wherein the rear wall portions of the vertically adjacent P-shaped channels overlap.

17. The merchandise display system of claim 12 wherein the channeled slatwall comprises at least two generally P-shaped channels which extend from a single contiguous rear wall.

18. A channeled slatwall for supporting various types of bracket hardware for supporting products in a retail display, the channeled slatwall made of a continuous piece of material having a substantially planar rear wall adapted to be attached to a supporting backer panel, the channel slatwall having at least two generally P-shaped channels which extend from the rear wall, the rear wall being contiguous with each of the channels, each of the channels having an upper flange orthogonal to the rear wall, an inner wall connected to the upper flange and spaced from and parallel to the rear wall, the inner wall connected through a radiused bend to an outer wall, the outer wall parallel to the rear wall and extending from one side of the upper flange to an opposite side of the upper flange, the outer wall connected to a stiffening web which is generally parallel to and spaced from the outer wall, the stiffening web connected to a lower flange which is closely adjacent to the upper flange and connected to the rear wall.

19. The channeled slatwall of claim 18 wherein spacing between the outer wall and the stiffening web is less than spacing between the stiffening web and the rear wall.

20. The channeled slatwall of claim 18 wherein the outer wall is connected to the stiffening web through two radiused bends of approximately ninety degrees each.

21. The channeled slatwall of claim 18 attached to a backer panel, the backer panel having corrugations disposed perpendicular to the P-shaped channels of the slatwall, and the rear wall of the slatwall secured to a surface of the backer panel.

22. The channeled slatwall of claim 18 further comprising at least one ridge in the rear wall between each of the P-shaped channels, and an offset ridge along one edge of the rear wall.

* * * * *